United States Patent [19]

McDade

[11] 4,110,602

[45] Aug. 29, 1978

[54] METHOD AND APPARATUS FOR FREEING A RAILROAD TANK CAR BOTTOM UNLOADING VALVE MADE INOPERABLE BY SOLIDIFIED FLUIDS WITHIN IT

[75] Inventor: George Harold McDade, Calgary, Canada

[73] Assignee: Chevron Research Company, San Francisco, Calif.

[21] Appl. No.: 703,046

[22] Filed: Jul. 6, 1976

[51] Int. Cl.[2] ..... H05B 3/06

[52] U.S. Cl. ..... 219/523; 105/451; 137/341; 138/33; 219/201; 219/202; 219/526

[58] Field of Search ..... 219/201, 200, 306, 316, 219/522, 523, 205, 208; 138/33; 137/341; 222/146 R, 146 H, 146 HE; 126/343.5 A; 105/451

[56] References Cited

U.S. PATENT DOCUMENTS

| | | | |
|---|---|---|---|
| 1,020,378 | 3/1912 | Wanamaker | 219/201 |
| 1,240,449 | 9/1917 | Hinshaw et al. | 219/201 |
| 1,524,658 | 2/1925 | Kelley | 219/208 |
| 1,706,997 | 3/1929 | Davis, Jr. | 219/201 |
| 1,831,832 | 11/1931 | Wise | 219/200 |
| 1,927,848 | 9/1933 | Richardson | 105/451 |
| 2,432,169 | 12/1947 | Morgan et al. | 219/331 |
| 2,560,795 | 1/1951 | Harris | 219/331 |
| 2,565,993 | 8/1951 | Schmid et al. | 137/341 |
| 2,744,992 | 5/1956 | Spears | 219/200 |
| 3,913,602 | 10/1975 | Yoon | 219/200 |

FOREIGN PATENT DOCUMENTS

| | | | |
|---|---|---|---|
| 837,436 | 4/1953 | Fed. Rep. of Germany | 219/201 |

OTHER PUBLICATIONS

Bragg, #2516950, Device for Thawing Frozen Water Pipes, Aug. 1, 1950, Fig. 1.

Folmsbee, #1534,102, Heated Discharge Outlet Casing for Tank Cars, Apr. 13, 1922, Fig. 1.

*Primary Examiner*—J. V. Truhe

*Assistant Examiner*—Bernard Roskoski

*Attorney, Agent, or Firm*—R. L. Freeland, Jr.; William J. Egan, III

[57] ABSTRACT

A portable apparatus for inserting into a bottom unloading valve of a railroad tank car which has been locked in an opened or partially opened position due to liquids solidifying therein. The apparatus is a portable electrical heating unit removably insertable into the valve so as to be in a heat-transmitting relationship within the fluid passage of the valve. The apparatus has a removable flange adaptor which is connected to the heating unit and securable directly to the bottom unloading valve or a fitting connected to the valve. A control means for regulating the heat output of the heating unit is electrically connected to the heating unit. A drain may be provided to allow the liquefied fluid to escape from the valve's fluid passage.

The method for using the apparatus comprises inserting the portable electrical heating unit into the fluid passage of the bottom unloading valve and removably connecting it into a heat-transmitting relationship within the fluid passage of the valve and then controlling the output of the portable heating unit to liquefy the solidified fluid so as to make the valve manually operable.

1 Claim, 5 Drawing Figures

METHOD AND APPARATUS FOR FREEING A RAILROAD TANK CAR BOTTOM UNLOADING VALVE MADE INOPERABLE BY SOLIDIFIED FLUIDS WITHIN IT

BACKGROUND OF THE INVENTION

1. Field of the Invention

This invention relates to a method of and apparatus for electrically heating a bottom unloading valve of a railroad tank car that is held open by liquids solidified therein or around the valve. The heating unit liquefies solidified fluids, making the valve manually operable.

2. Description of the Prior Art

It has been my experience that when railroad tank cars are emptied through bottom unloading valves which are then left completely or partially open, these valves may become locked in that position. This occurs when the liquids that they had been carrying have the characteristics of solidifying at ambient temperature. The reason is simply these fluids get trapped in and around the moveable components of the valve which, when the fluids become solidified, make the valve manually inoperable. Examples of some of the chemicals that are ordinarily transported in a liquid or molten state but become solidified fluids at ambient temperature (e.g. 70° F or 21° C), are sulfur (melting point (m.p.) 112.8° C); maleic anhydride (m.p. 58° C); phenol (m.p. 40.6° C); and phthalic anhydride (m.p. 131.2° C).

At locations where steam heat is provided, these locked-open valves may be made manually operable by passing steam through conduits located throughout the tank car. However, there are times and places where steam is not available. Additionally, it is inefficient to heat the entire tank car when only one valve requires it.

Others have proposed electrically heating tank cars through impedance or resistance heating. However, this approach is expensive and inefficient to use as in the case of steam, since the entire tank car is heated. Another difficulty, like that of steam, is adequate electrical power may not be available.

Another possible solution might be to replace manually operated valves with automatic closing ones; that is, valves which immediately close after the car is unloaded. The problem here is that manual valves are in widespread use now, and would be quite costly to replace. On the other hand, the heating device described in detail below is an apparatus that can be used to free the valve of almost any manufacturer, located on any tank car.

SUMMARY OF THE INVENTION

The present invention is directed to both an apparatus and method to make manually operable a bottom unloading valve of a railroad tank car which is held open by a solidified fluid that had previously been transported within the railroad tank car.

Concisely, the apparatus includes a portable electrical heating unit which is removably insertable through the bottom fitting of the unloading valve so that it is in a heat-transmitting relationship within the valve's fluid passage. Further, the heating apparatus has a flange that may be removed entirely or replaced with the necessary fitting so as to be securable to any unloading valve. Connected to the heating apparatus is a control means for regulating the heat output of the apparatus.

The method of using the above apparatus includes the steps of inserting the heating unit into the valve's fluid passage so as to be in a heat-transmitting relationship therein. After insertion of the heater unit, an adaptor flange or fitting — for keeping the heating unit in its heat transmitting relationship with the valve — is connected to the bottom fitting of the valve. The length of heater unit extending into the valve is adjusted by sliding the heater unit along a slip joint to the appropriate position where it is held there by one or more set screws.

The unit's heat output is regulated through a control means so as to liquefy the solidified fluid. By using the apparatus and the method steps described herein, the unloading valve is readily made operable at locations where heretofore these valves caused difficulty.

DESCRIPTION OF THE PREFERRED EMBODIMENT

Figure 1:
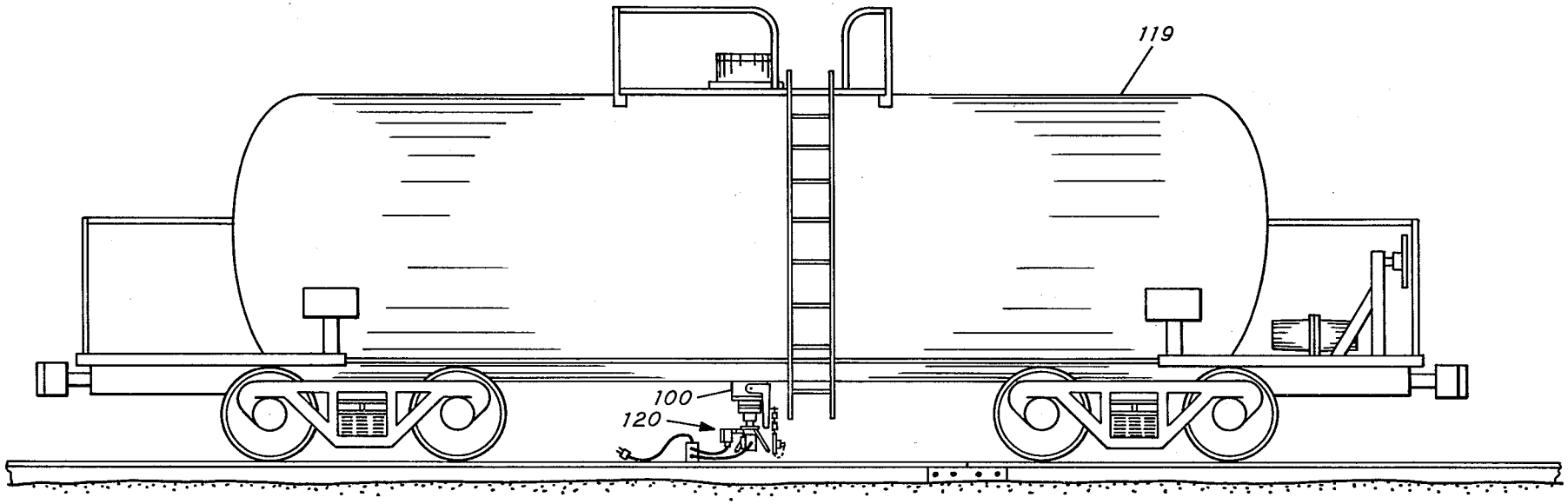
FIG. 1 illustrates the present invention connected to a railroad tank car.

An embodiment of the present invention is shown secured to the bottom unloading flange of a railroad tank car 119, FIG. 1. This figure illustrates the environment where the heating apparatus 120 is used.

Figure 5:
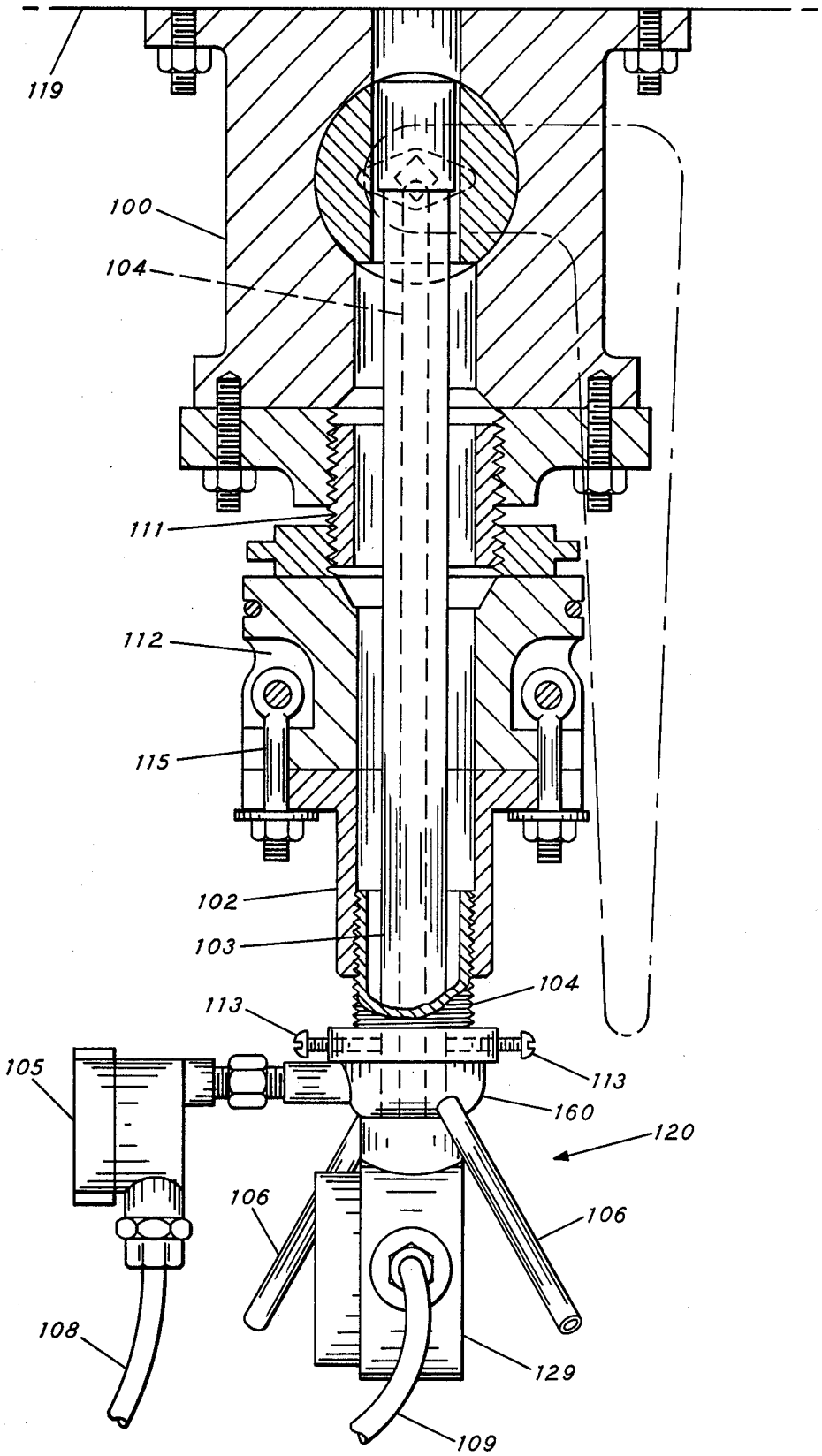
FIG. 5 illustrates a cut-away section of an embodiment of the present invention positioned in a completely opened ball valve.

FIG. 5 shows the heater unit or body 103 connected for operation to the tank car's unloading valve. As illustrated flange adaptor 102 is connected to the bottom fitting of the railroad tank car valve 100. The heater unit 103 is then inserted into the flange adaptor 102 and screwed or otherwise fastened to the adaptor by holding cap 160. The apparatus is then adjusted for penetration into the fluid passage of the tank car valve by slipping the heater body 103 within the holder cap 160. When the heater is in the desired position it is locked there by set screws 113 which engage threads previously tapped through the holder cap 160. These set screws are tightened against heater unit 103. In this manner, the entire apparatus including the heating unit, slip joint and flange adaptor is secured to the valve. Though a flange adaptor is illustrated, adaptor 102 may be removed and replaced with another suitable fitting that mates with the fitting on the tank car valve.

Figure 2:
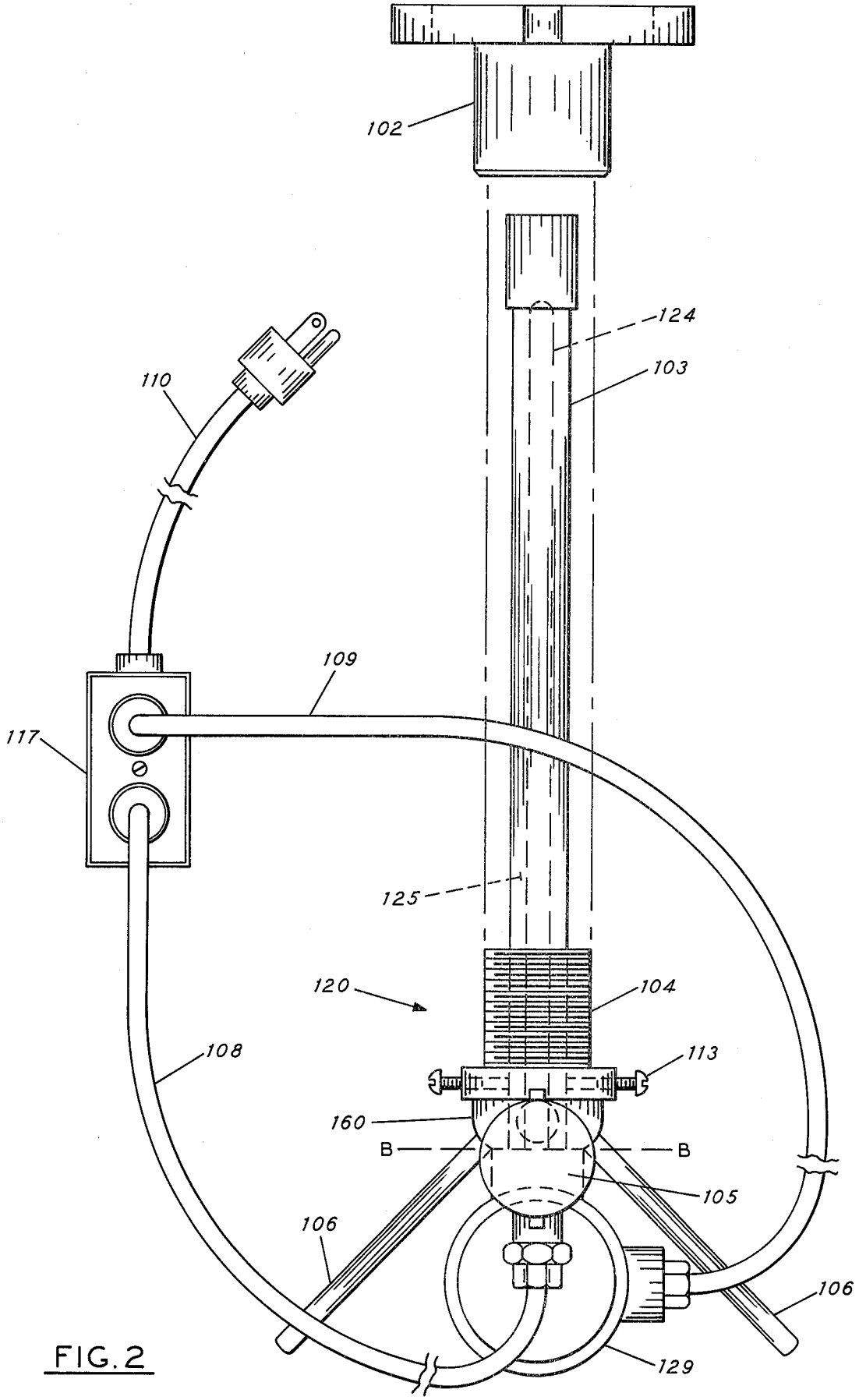
FIG. 2 illustrates one embodiment of the present invention in a partially expanded view.

As shown in FIG. 2, the heating unit is made up of a heater element 124 encased and cemented in a smooth outer cover. The cover protects the element and acts as a slip joint by allowing the heating unit to slide within the holder cap 160. The space between the cover and the heater element (up to dashed line B—B where the heater element passes through the holder cap) is filled with a heat conducting cement 125, such as Thermon T-63 made by Thermon Manufacturing Co., Houston, Tex. The section of the heater element from the holder cap (i.e. dashed line B—B) down to and including terminal box 129 is filled with an insulating cement such as "Chico A" distributed by Crouse-Hinds to prevent heat escaping and to protect the electrical wiring from overheating.

The heat output of the apparatus is controlled by control means such as thermostat 105 electrically and mechanically connected at one end of the heater unit. This thermostat is also electrically connectable by insulated electrical conductor 108 through series wired junction box 117 that has insulated electrical conductor 110 extending to an electrical outlet (not illustrated) connectable to an external source of electrical power. Another insulated electrical conductor 109 extends from the junction box to terminal box 129 to provide electrical power to the heater terminals. This arrangement provides a means to control or regulate the heat output from the heater element through a thermostatically controlled relay. Thus sufficient heat is available to liquefy the solidified fluid while the temperature of the fluid is maintained below its ignition temperature.

A draining means 106 may be included to drain the liquid while heating the valve so as to avoid the fluid resolidifying before the apparatus 120 is removed.

Figure 3:
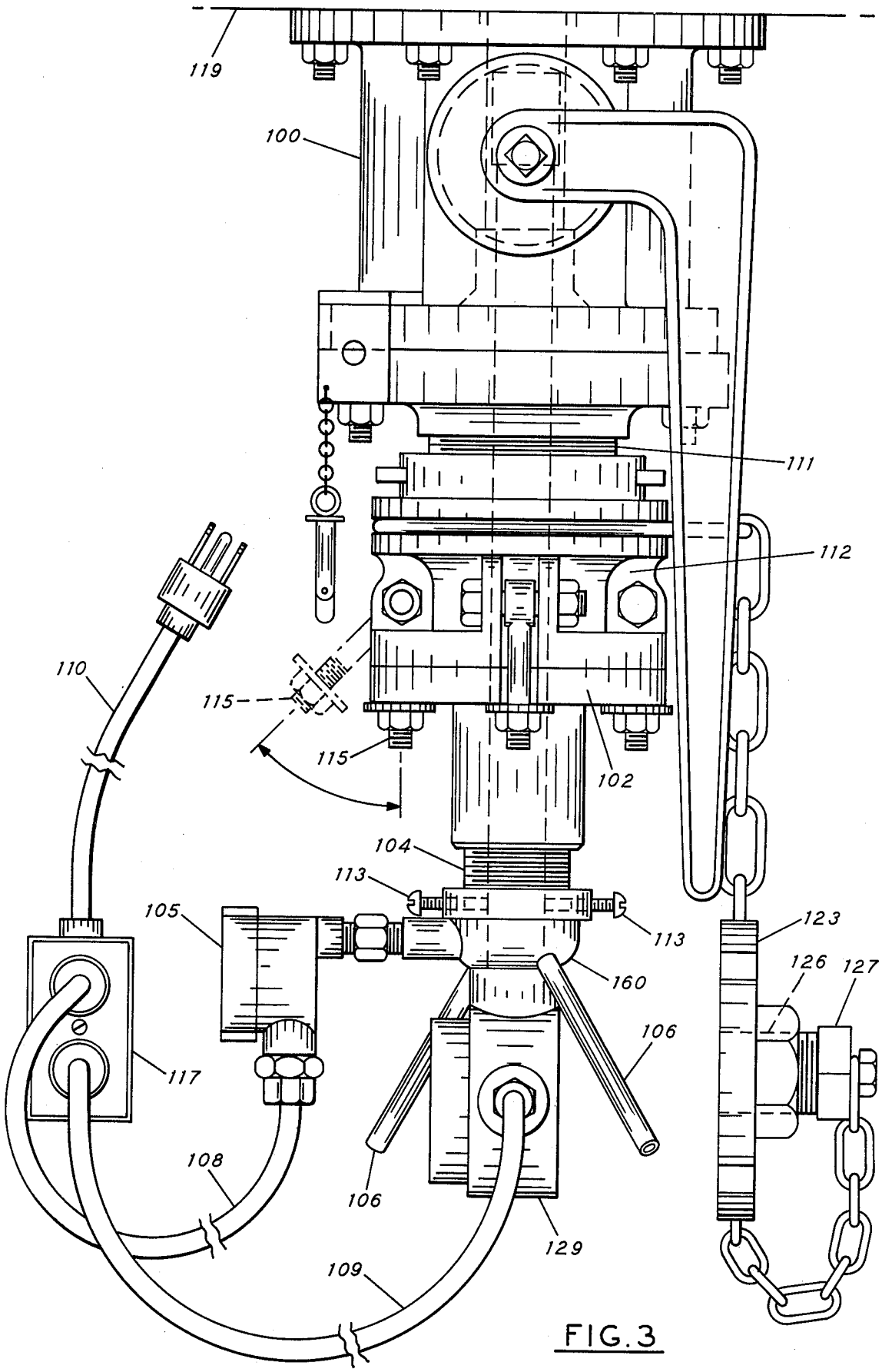
FIG. 3 illustrates in more detail the present invention connected to the bottom flange of a railroad tank car unloading valve.

The completely assembled embodiment of the invention is connected as shown in FIG. 3 to the bottom unloading valve 100 through its fitting 112 and extension member 111. This embodiment is held in place by removably securable bolts 115 which are connected to the unloading valve's fitting and are swung down so as to secure the flange of the heating apparatus to the valve.

At times, particularly during transit, the bottom unloading valve might be covered with blank 123 which is commonly placed over the valve opening at the unloading site after the product has been removed from tank car. Blank 123, of course, must be removed prior to inserting the heating apparatus. It is noted that on some tank cars the threaded opening 126 on blank 123 will accommodate the threaded section 104 of the apparatus. In such a case, threaded plug 127 of the blank is removed and the heating unit of the apparatus inserted into the valve passage through opening 126 and screwed into position without requiring flange adaptor 102.

Figure 4:
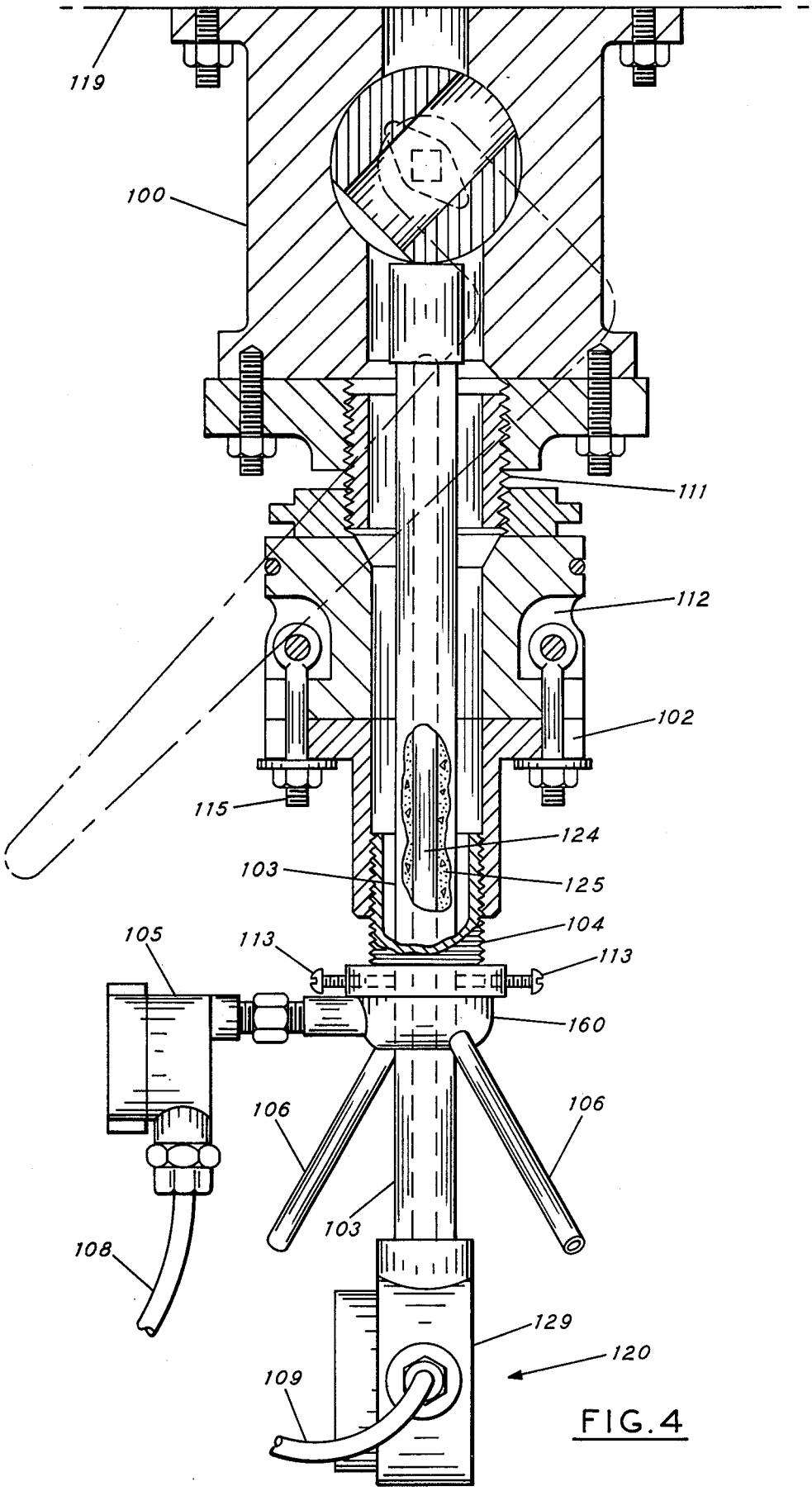
FIG. 4 illustrates a cut-away section of an embodiment of the invention positioned in a partially opened ball valve.

FIGS. 4 and 5 are cut-away sections that illustrate the present invention extended into a ball valve. For instance, in a partially opened ball valve, the heater unit extends into the fluid passage of the valve so as to be near or in contact with the partially opened ball as shown in FIG. 4.

On the other hand, FIG. 5 illustrates a ball valve which is completely opened. In this situation, the heater unit may extend into the ball. In both FIGS. 4 and 5, the heater unit is locked into position by set screws 113 screwed through holder cap 160 as mentioned before.

The foregoing describes a selected embodiment of the present invention in detail. The invention, however, is not to be limited to any specific embodiment, but rather only by the scope of the appended claims.

What is claimed is:

1. A portable steamless heating apparatus for use with a bottom unloading valve of a railroad tank car, said valve having a central vertical fluid passageway for the unloading of liquids transported in said tank car and a stop member movable to open and close said passageway through which liquids are unloaded, said valve being manually inoperable due to solidification of liquids in said fluid passageway and said stop member, said valve further including a lever for manual operation of the valve and said fluid passageway terminating in a flange member having a central opening forming an axial extension of said fluid passageway, and an external flange member for connecting flow from said valve to a fluid unloading system, said heating apparatus comprising:

an elongated cylindrical electrical heating unit axially insertable through said central opening in said flange member into said fluid passageway of said valve, one end of said unit being adapted to contact said stop member so as to be in direct heat transmitting relationship with said fluid passageway of said valve when a heating element of said heating unit is energized to liquefy solidified fluid which may be contained therein to make said stop member of said valve operable;

an externally threaded tubular member having an opening therethrough surrounding the other end of said heating unit for threadably securing said unit to said flange member, a cap member having an opening therein slidably engaging the cylindrical surface of said heating unit, said cap member joined to the external end of said tubular member forming a closure for the external end of said tubular member, retaining means mounted on said cap member for slidably holding said heating unit in said tubular member so that said one end of said heating unit is adjustably positionable relative to said stop member of said valve;

drain means formed in said cap member for draining the fluid from said valve passageway and around said heating unit, and electrical power control means mounted on said other end of said heating unit for regulating the heat output of said heating unit to liquefy said solidified fluid, said control means including means for electrically connecting the heater element of said heating unit to an external source of electrical power.

* * * * *